US008505145B2

(12) United States Patent
Oohiro et al.

(10) Patent No.: US 8,505,145 B2
(45) Date of Patent: Aug. 13, 2013

(54) CENTRAL CORE FOR A CLEANING SPONGE ROLLER

(75) Inventors: Nagayo Oohiro, Koga (JP); Tadashi Kawaguchi, Koga (JP); Hiroshi Miyaji, Koga (JP)

(73) Assignee: Aion Co., Ltd., Osaka (JP)

( * ) Notice: Subject to any disclaimer, the term of this patent is extended or adjusted under 35 U.S.C. 154(b) by 0 days.

(21) Appl. No.: 12/995,560

(22) PCT Filed: Jun. 6, 2008

(86) PCT No.: PCT/JP2008/060457

§ 371 (c)(1),
(2), (4) Date: Jan. 3, 2011

(87) PCT Pub. No.: WO2009/147747

PCT Pub. Date: Dec. 10, 2009

(65) Prior Publication Data

US 2011/0088191 A1 Apr. 21, 2011

(51) Int. Cl.
*B05C 1/10* (2006.01)
*B08B 11/00* (2006.01)

(52) U.S. Cl.
USPC ..... 15/102; 15/230; 15/230.11

(58) Field of Classification Search
USPC ..... 15/102, 230.11
See application file for complete search history.

(56) References Cited

U.S. PATENT DOCUMENTS

| | | | | |
|---|---|---|---|---|
| 3,877,123 | A * | 4/1975 | Pharris | 492/19 |
| 4,077,082 | A * | 3/1978 | Roe et al. | 15/230.11 |
| 4,566,911 | A | 1/1986 | Tomita et al. | |
| 5,806,126 | A | 9/1998 | de Larios et al. | |
| 5,979,009 | A * | 11/1999 | Polzin et al. | 15/230.11 |
| 6,240,588 | B1 | 6/2001 | Dickey et al. | |
| 6,247,197 | B1 | 6/2001 | Vail et al. | |
| 6,308,369 | B1 | 10/2001 | Garcia et al. | |
| 6,543,084 | B2 | 4/2003 | Dickey et al. | |
| 7,841,036 | B2 * | 11/2010 | Smith | 15/104.002 |
| 2002/0138935 | A1 * | 10/2002 | Lanz | 15/230.11 |
| 2007/0022554 | A1 * | 2/2007 | Wang | 15/230.11 |
| 2007/0163066 | A1 | 7/2007 | Okuzono et al. | |

FOREIGN PATENT DOCUMENTS

| | | |
|---|---|---|
| JP | U-5-92533 | 12/1993 |
| JP | U-3011644 | 5/1995 |
| JP | A-2006-297178 | 11/2006 |
| WO | WO 2005/065849 A1 | 7/2005 |

OTHER PUBLICATIONS

International Search Report in International Application No. PCT/JP2008/060457; dated Jul. 8, 2008 (with English-language translation).

(Continued)

*Primary Examiner* — Randall Chin
(74) *Attorney, Agent, or Firm* — Oliff & Berridge, PLC

(57) ABSTRACT

An approximately cylindrical central core for cleaning sponge roller having an axially extending internal hole and multiple small holes realizing communication from the internal hole to the circumferential external surface. The central core for cleaning sponge roller is characterized in that the external surface of the central core is provided in the circumferential direction with multiple axially slender projections and that the projections each has an axial section viewed from a direction perpendicular to the axial direction that is not flat.

8 Claims, 2 Drawing Sheets

(56) References Cited

OTHER PUBLICATIONS

International Preliminary Report on Patentability in International Application No. PCT/JP2008/060457; dated Jan. 11, 2011.

Feb. 7, 2013 English-language Translation of Final Office Action issued in Japanese Patent Application No. 2010-515723.

Supplemental English-language Translation of Japanese Utility Model Application Laid-Open No. Hei-5-92533; Laying Open Date Dec. 17, 1993.

Sep. 19, 2012 Office Action issued in Japanese Patent Application No. 2010-515723 (with English Translation).

Feb. 7, 2013 Final Office Action issued in Japanese Patent Application No. 2010-515723.

* cited by examiner

CENTRAL CORE FOR A CLEANING SPONGE ROLLER

FIELD OF THE INVENTION

The present invention relates to a central core for a cleaning sponge roller, more specifically a central core to be attached to a cleaning sponge roller and to be used in a cleaning step in the preparation of substrates.

BACKGROUND OF THE INVENTION

In a manufacturing process of aluminum hard disks, glass disks, wafers, photo-masks or liquid crystal glass substrates, there is performed a precise polishing, so-called polishing process, using various abrasive grains such as silicon oxide, alumina and eerie in order to finish a surface of the aforementioned aluminum hard disks and so on with extremely high precision. Abrasive grains and polishing dust adhere to the surface polished in the polishing process. In order to remove them, sufficient cleaning has to be performed subsequently.

ultrasonic cleaning and water jet cleaning are known. However, scrub cleaning with a sponge roller made of a polyvinyl acetal-based porous material is widely employed in order to achieve a high cleaning effect and to reduce damages on the substrate. Further, DI water as well as various chemicals suitable for particular substrates such as acids, alkalis and solvents is usually used as a cleaning fluid. For instance, as a cleaning fluid for silicon wafers, a mixed solution of ammonia water and aqueous hydrogen peroxide, dilute hydrofluoric acid, and a mixed solution of hydrochloric acid and aqueous hydrogen peroxide are known.

Among sponge rollers made of a polyvinyl acetal-based porous material, cylindrical brush rollers having a large number of projections on a circumferential surface thereof are widely used for the above-described cleaning, where top portions of the projections are continuously brought into contact with a cleaning surface of en object to be cleaned while the sponge roller is rotated to thereby obtain a good cleaning effect (U.S. Pat. No. 4,566,911). Because only the projections are brought into contact with the object to be cleaned, friction is less, compared to a sponge roller with a flat surface, so that damages on the object to be cleaned are less, and further there is an advantage that dirt passes easily through between the projections together with the cleaning fluid to be removed from the object to be cleaned.

Cleaning devices dedicated to particular substrates are usually used in a cleaning process. It is common among all of the devices that a central core connected to a rotation driving part is covered with a cleaning sponge roller, and the sponge roller is rotated together with the central core, while keeping top portions of projections of the roller into contact with an object to be cleaned.

There are devices where a cleaning fluid is fed through a nozzle or the like to an upper or side portion of an object to be cleaned or of a sponge roller. It is also performed to supply a cleaning fluid to an inside of the sponge roller from the inside of the central core to attain better cleaning capability. In the latter case, the central core has a hollow cylindrical shape, and the cleaning fluid is introduced from one end of the central core, supplied to the sponge roller through holes communicating between the hollow portion and an outer surface of the central core, and then flows out to the outer surface of the sponge roller.

U.S. Pat. No. 6,240,588 discloses a brush core which is characterized by having a plurality of first holes aligned in a straight line in an axial direction of the core and a plurality of second holes aligned in a straight line in the axial direction of the core, in which the first hole group and the second hole group are alternately located, the first hole group alternate with the second hole group in a repeated manner around the core, and the first hole group and the second hole group are located in grooves recessed from the outer surface of the core. A bore at the center of the core has a diameter of 0.060 to 0.35 inch (1.524 to 8.89 mm).

U.S. Pat. No. 6,543,084 discloses a brush core made of an elongated member, in which the elongated member has a plurality of fluid discharge surfaces around and remotete from its center axis, a plurality of the fluid discharge surfaces being provided with a space therebetween, the elongated member has, at a center thereof, a fluid supply bore with a diameter of 0.060 to 0.35 inch (1.524 to 8.89 mm), and a plurality of holes communicating between the fluid supply bore and the fluid discharge surfaces. Each of a plurality of the holes communicating between the fluid supply bore and the fluid discharge surfaces has a diameter of 0.005 to 0.092 inch (0.127 to 2.34 mm).

U.S. Pat. No. 6,308,369 discloses a wafer cleaning device hiving a brush assembly comprising a brush core in which channels are cut along a surface in an axial direction thereof, a first cylindrical sleeve which is concentric with the brush core, and a second sleeve (main brush body), wherein the channels allow a fluid to flow in the axial direction of the brush core and to the first and second sleeves.

U.S. Pat. Nos. 6,247,197 and 5,806,126 disclose a device comprising a cleaning brush mounted thereon.

WO2005/065849 discloses a central core for a cleaning sponge roller capable of uniformly supplying a cleaning fluid to the sponge roller and quickly completing replacement of cleaning fluids at the time of switching the cleaning fluids. Absolute sizes and relative sizes of bore extending in an axial direction of the central core and a plurality of the small holes communicating to a circumferential outer surface of the central core are defined. A plurality of the small holes are distributed in a circumferential direction and the axial direction of the central core and arranged on straight lines in the axial direction, wherein the small holes disposed on one of the straight lines and the small holes disposed on a straight line adjacent to the aforesaid straight line are arranged on common circumferences of the central core, grooves recessed from the circumferential outer surface of the central core are formed in the axial direction of the central core, and the small holes are open in the grooves.

SUMMARY OF THE INVENTION

Problems to be Solved by the Invention

The present inventors found that where a conventional central core is covered with a sponge roller and used for cleaning, the sponge roller twists in a rotational direction (circumferential direction) and shifts in an axial direction with the passage of time to thereby cause non-uniformity in cleaning. The present invention has been made to solve the above problems.

The present invention is a substantially cylindrical central core (1) for a cleaning sponge roller, having a bore (2) extending in an axial direction and a plurality of small holes (3) communicating between the bore (2) and a circumferential outer surface, characterized in that a plurality of axially elongated projections (4) are provided along a circumference on the outer surface of the central core (1), and a transverse section of each of the projections (4) viewed from a direction perpendicular to the axial direction has concave and convex portions (5A, 5B).

BRIEF DESCRIPTION ON THE DRAWINGS

FIGS. 1A-1D shows an example of a central core for a cleaning sponge roller of the present invention, in which FIG. 1A is a perspective view of the central core, FIG. 1B is a side view along an axial direction of the central core, FIG. 1C is a sectional view taken along X-X in FIG. 1B, and FIG. 1D is a sectional view taken along Y-Y in FIG. 1B;

FIGS. 2A-2D shows another example of the central core for a cleaning sponge roller of the present invention, in which FIG. 2A is a perspective view of the central core, FIG. 2B is a side view along an axial direction of the central core, FIG. 2C is a sectional view taken along X-X in FIG. 2B, and FIG. 2D is a sectional view taken along Y-Y in FIG. 2B;

BEST MODES OF THE INVENTION

Figure 1A:
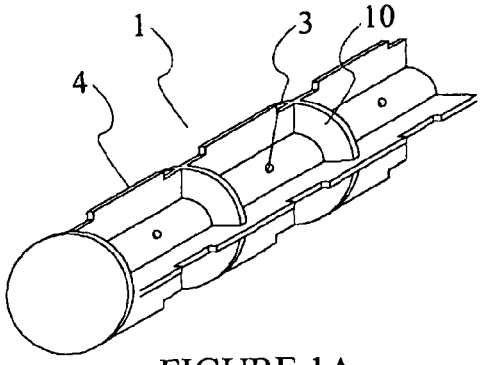
Figure 1C:
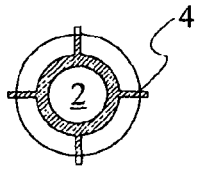
Figure 1D:
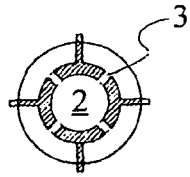
Figure 1B:
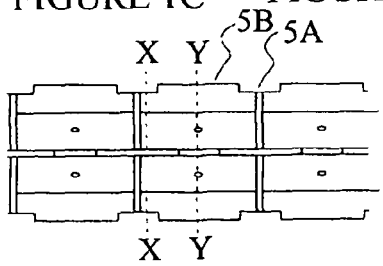
Figure 2A:
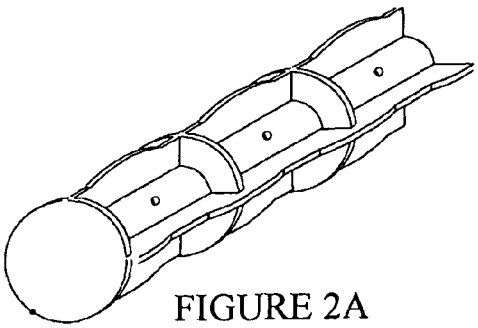
Figure 2C:
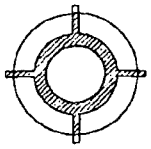
Figure 2D:
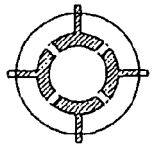
Figure 2B:
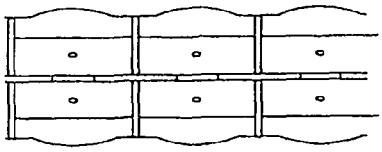

The present invention will be explained with reference to FIG. 1. FIG. 1 shows an example of a central core for a cleaning sponge roller of the present invention, in which FIG. 1A is a perspective view of the central core, FIG. 1B is a side view along an axial direction of the central core, FIG. 1C is a sectional view taken along X-X in FIG. 1B, and FIG. 1D is a sectional view taken along Y-Y in FIG. 1B. In FIG. 1, a central core (1) is in a hollow cylindrical shape, and has a bore (2) extending in an axial direction and a plurality of small holes (3) communicating between the bore 2 and an outer surface of the central core (1). A diameter of the bore is 5 mm to 20 mm, preferably 7 mm to 15 mm; and a diameter of the small holes is 0.5 mm to 5 mm, preferably 0.8 mm to 3 mm.

A plurality (4 in FIG. 1) of axially elongated projections (4) are provided in a circumferential direction on the outer surface of the central core, and a transverse section of each of the projections (4), viewed from a direction perpendicular to the axial direction, has concave and convex portions (5A, 5B). When a sponge roller is set on such a central core, the convex portions (5B) of the projections (4) bite into a soft inner surface of the sponge roller to firmly hold the sponge roller. Therefore, the sponge roller is prevented from being twisted in a rotational direction (circumferential direction) and being shifted in the axial direction, which ensures uniform cleaning.

A height between the concave and convex portions (difference in height between 5A and 5B in FIG. 1B) is preferably 0.3 to 5 mm, more preferably 0.3 to 2 mm. The projections (4) can be board-shaped ribs as shown in FIG. 1, but is not limited to this. Preferably for reinforcement, the board-shaped ribs are integrally coupled to other ribs (10) extending in a circumferential direction. The ribs (10) also serve to prevent the sponge roller from being shifted in the axial direction. The height of the projection measured at the concave portion may be appropriately set, and is preferably 1 mm to 20 mm, more preferably 2 mm to 15 mm.

The number of the projections in the circumferential direction of the central core is preferably at least 4 (4 in FIG. 1), more preferably 8 to 32. Usually, one projection continues from one end to the other end of the central core, but not limited to this embodiment. Anyway, at least 2, more preferably 4 to 20, convex portions are provided on a virtual straight line parallel to the axial direction of the central core (here, the virtual line is in the same direction as an axial direction of the projection where a projection continues from one end to the other end of the central core).

It is preferred that the concave portions or the convex portions of the projections on the virtual straight lines adjacent to each other are not provided on the same circumference of the central core. In FIG. 1, the concave portions (5A) and the convex portions (5B) on one projection and the concave portions (5A) and the convex portions (5B) on the adjacent projection are, respectively, not on the same circumference. More preferably, a plurality of the concave portions (5A) and the convex portions (5B) are arranged in an alternating checkerboard pattern on the circumferential surface of the central core, whereby the effect of the present invention is further enhanced.

FIG. 2 shows another embodiment of the present invention, in which concave and convex portions (5A, 5B) are formed in a wave shape with no sharp corners. This enables one to smoothly attach and detach the sponge roller to and from the central core.

Figure 3:
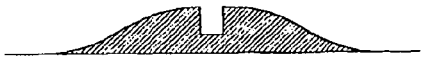
FIG. 3 is a side view of an embodiment of a convex portion in which a projection in a central core for a cleaning sponge roller of the present invention has a recessed portion.

FIG. 3 shows an embodiment wherein there are one or more recessed portions in the vicinity of top portions of the concave and convex portions (5A, 5B). Accordingly, in particular, even when the concave and convex portions (5A, 5B) themselves are formed in a wave shape with no sharp corners, as in FIG. 2, the sponge roller can be securely held during the cleaning process. Preferably, a length of the recessed portion in the axial direction of the central core is 0.3 to 10 mm and a depth of the recessed portion is 0.3 to 5 mm.

The size and the number of the small holes (3) communicating between the bore (2) and the circumferential outer surface are not limited to those in the embodiment illustrated in FIG. 1, but may be as well known, for example, those described in WO2005/065849.

Figure 4:
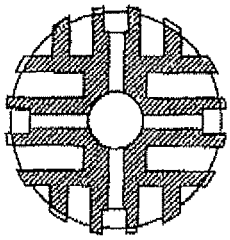
FIG. 4 is a sectional view of another example of the central core for a cleaning sponge roller of the present invention.

The projections (4) need not to be directed to a center axis of the central core as shown in FIGS. 1 and 2, but may be directed to a direction deviated from the center axis of the central core, as shown in FIG. 4, which embodiment is preferred in terms of strength and easiness of injection molding.

A material for the central core of the present invention is not particularly limited, and can be appropriately selected from polyethylenes, polypropylenes, polyesters, polyacetals, polycarbonates, fluorinated resins, and hard polyvinyl chlorides, in consideration of the strength and resistance to chemicals to be used. Further, as a method for molding the central core, injection molding, cast molding or grinding, for instance, can be appropriately adopted. The injection molding method is preferably used, in which the central core can be formed using a die composed of four segments which cover a cross section perpendicular to the axial direction of the central core. The central core having a cross section shown in FIG. 4 can be manufactured by the four-segment dies as described above.

Although not shown in FIGS. 1 and 2, one end portion of the central core is provided with a sleeve to be inserted into a rotation driving part (not shown) of a cleaning device, and the bore 2 is closed at this end portion. The bore 2 is open at the other end portion of the central core, to which end portion a cleaning fluid supply pipe (not shown) is connected. A length in the axial direction of the central core and a diameter measured at the concave portions of the projections of the central core depend on a length in the axial direction and an inner diameter of the sponge roller, and generally can be in a range of 50 to 500 mm and in a range of 15 to 100 mm, respectively.

The cleaning sponge roller is applied on the central core from the direction of the above-described other end portion to thereby form a cleaning sponge roller set. As the cleaning sponge roller itself, known cleaning sponge rollers, for example, such as disclosed in U.S. Pat. No. 4,566,911, can be used.

Preferably, one or both of the end portions of the central core are provided with a flange or flanges, which can be attached/detached, for instance, by screws. In such a case, a flange is first detached, the sponge roller is mounted on the central core, and the flange is fitted. Thus, the sponge roller is ready for use. The flange prevents the sponge roller from shifting in the axial direction on the central core during a cleaning process.

INDUSTRIAL APPLICABILITY

The present invention provides a central core on which a cleaning sponge roller used in a cleaning process for disks and wafers is mounted.

The invention claimed is:

1. A substantially cylindrical central core for a cleaning sponge roller, comprising:

a bore extending in an axial direction; and a plurality of small holes communicating between the bore and a circumferential outer surface of the central core, wherein at least eight axially elongated projections are provided along a circumference on the outer surface of the central core, the projections are substantially board-shaped ribs rising from the outer surface of the central core, a transverse section of each of the projections viewed from a direction perpendicular to the axial direction has concave and convex portions, a height between the concave and convex portions is 0.3 to 5 min, at least four convex portions are provided on a virtual straight line parallel to the axial direction of the central core, a plurality of the concave portions and convex portions are each arranged in different alternating patterns on the circumferential surface of the central core, and the projections are integrally coupled to ribs extending in a circumferential direction.

2. The central core according to claim 1, wherein one or more recessed portions are provided in the vicinity of top portions of the concave and convex portions.

3. The central core according to claim 2, wherein a length of the recessed portions in the axial direction of the central core is 0.3 to 10 mm and a depth of the recessed portions is 0.3 to 5 mm.

4. The central core according to claim 1, manufactured by injection molding.

5. The central core according to claim 1, wherein the board-shaped ribs are integrally coupled to a plurality of secondary ribs at the concave portions, the plurality of secondary ribs extending in a circumferential direction on the outer surface of the central core.

6. A substantially cylindrical central core for a cleaning sponge roller, comprising:

a bore extending in an axial direction; and a plurality of small holes communicating between the bore and a circumferential outer surface of the central core;

a plurality of rows including a plurality of axially elongated projections provided along a circumference of the outer surface of the central core, wherein a transverse section of each of the projections viewed from a direction perpendicular to the axial direction have concave and convex portions, each of the plurality of rows are arranged adjacent each other on the outer surface of the central core, and the concave and convex portions of at least two adjacent rows are arranged in different alternating patterns.

7. The central core according to claim 6, wherein the projections are integrally coupled to a plurality of ribs extending in a circumferential direction on the outer surface of the central core.

8. The central core according to claim 7, wherein the ribs are integrally coupled to the concave portion of at least one row while at the same time, also being integrally coupled to the convex portion of an adjacent row.

* * * * *